US010024040B1

(12) United States Patent
Lowery

(10) Patent No.: US 10,024,040 B1
(45) Date of Patent: Jul. 17, 2018

(54) DISHWASHER / GARBAGE DISPOSAL CLOG DRAIN CONNECTOR / RUBBER SPLASH GUARD CLEANER AND PERMANENT ODOR PREVENTION KIT

(71) Applicant: Dorothy Mae Lowery, San Pedro, CA (US)

(72) Inventor: Dorothy Mae Lowery, San Pedro, CA (US)

( * ) Notice: Subject to any disclaimer, the term of this patent is extended or adjusted under 35 U.S.C. 154(b) by 0 days.

(21) Appl. No.: 15/661,152

(22) Filed: Jul. 27, 2017

Related U.S. Application Data

(60) Provisional application No. 62/367,804, filed on Jul. 28, 2016.

(51) Int. Cl.

| | |
|---|---|
| ***E03C 1/30*** | (2006.01) |
| ***E03C 1/302*** | (2006.01) |
| ***E03C 1/126*** | (2006.01) |
| ***E03C 1/266*** | (2006.01) |

(52) U.S. Cl.
CPC ..... *E03C 1/302* (2013.01); *E03C 1/126* (2013.01); *E03C 1/266* (2013.01)

(58) Field of Classification Search
CPC ..... E03C 1/302; E03C 1/126; E03C 1/266; E03C 1/30; A46B 13/10; A46B 11/0013; A46B 3/18
See application file for complete search history.

(56) References Cited

U.S. PATENT DOCUMENTS

| | | | | |
|---|---|---|---|---|
| 2,895,155 | A * | 7/1959 | Peterson | A46B 3/18 15/192 |
| 5,209,380 | A * | 5/1993 | Williams | B65D 83/28 222/402.13 |
| 6,047,432 | A * | 4/2000 | Sode | A46B 9/02 15/160 |
| 6,250,829 | B1 * | 6/2001 | Brower | A45D 34/04 15/227 |
| 6,827,794 | B2 * | 12/2004 | Sommerfeld, Sr. | A46B 3/18 134/8 |
| D598,200 | S * | 8/2009 | DiAntonio | D4/116 |
| 2009/0307858 | A1 * | 12/2009 | Gionet | A47L 13/18 15/104.93 |

OTHER PUBLICATIONS

Cylinder Bottles with Finger Sprayers. United States Plastic Corp. Apr. 15, 2016.*

* cited by examiner

*Primary Examiner* — Shay Karls

(57) ABSTRACT

Purpose of foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is intended to define the disclosure in anyway, which the disclosure described with respect to specific embodiment(s), it will be appreciated that many modifications and changes may be made by those skilled in the art without departing from the spirit of the disclosure, intending by the description to cover all modifications and changes within the true spirit and scope of the disclosure. Particular to above description to be realized that the optimum dimensional relationships for the parts of the exemplary embodiments(s) may include variations in size, materials, shape form, function, manner of operation.

1 Claim, 2 Drawing Sheets

DISHWASHER / GARBAGE DISPOSAL CLOG DRAIN CONNECTOR / RUBBER SPLASH GUARD CLEANER AND PERMANENT ODOR PREVENTION KIT

CROSS REFERENCE TO RELATED APPLICATIONS

Provisional patent application No. 62/367,804

FEDERALLY SPONSORED RESEARCH OR DEVELOPMENT

Not Applicable

MATERIAL SUBMITTED ON A COMPACT DISC OR AS A TEXT FILE VIA THE OFFICE ELECTRONIC FILING SYSTEM (EFS-WE)

Not Applicable

BACKGROUND OF THE INVENTION

Field of the invention relates generally to a three-item cleaning kit to prevent and or permanently remove bad odors from the garbage disposal that's caused by the waste build-up under the rubber splash guard of the top entry of the garbage disposal, also bad odors, and clogs from the waste build-up inside the top small drain hole that's connected to the outside hose of the dishwasher. The kit contains a specifically designed brush that's flexible to accommodate the inner top angle to the small top drain opening inside of the garbage disposal, and not for the use of cleaning the whole garbage disposal, or the bottom large sewer drain hole. The other two items are a four-finger only water-resistant scrubbing mitt for the right or left hand, to remove waste build-up under the rubber splash guard of the garbage disposal, and a small reusable plastic one finger spray pump bottle with a liquid lemon scented disinfectant.

Prior related designs don't have a three-item unique design kit that's convenient, easy to use, lightweight yet durable in design, versatile in its applications, and designed for providing an easy, effective means of maintaining a fresh and clean garbage disposal while eliminating the need to employ a costly plumber to eradicate clogs, bad odors, and designed to look appropriate for residential or commercial use, and not designed for the use of cleaning the inside of the whole area of the garbage disposal or the larger bottom sewer drain hole.

The garbage disposal was invented in 1927 by John W. Hammes, an architect working in Racine, Wis. After eleven years of development, his InSinkErator company put his disposal on the market in 1940. Although they did not immediately catch on to the garbage disposal units, it became extremely popular in American Kitchens in the 1970s and 1980s, as the desire for time-saving home appliances correlated with increasingly busy schedules. In the U.S., fifty percent (50%) of homes had disposal units as of 2013, that reduced food waste into small pieces for the drain.

Typically, kitchen plumbing does not include a drain line for dishwashers. For this reason, dishwashers install under the counter top next to the sink cabinet, with a drain hose through the side of the cabinet. The dishwasher pumps discarded water and food particles through the hose and into the garbage disposal. The drain system includes an air-gap fitting that prevents water and debris from backing up into the dishwasher and out of the air-vent. However, a common problem experienced by dishwasher owners who join the appliance with the garbage disposal is that the small upper top round hole inside of the garbage disposal becomes clogged, leading to a foul build-up of unpleasant, odors. Unfortunately, this can become so serious a professional plumber will be needed, at an extreme cost, that could be eliminated if the kit is used to prevent and remove clogs, and bad odors from the garbage disposal, which the cost of a plumber could not be practical for many consumers.

Accordingly, a need remains for a clog cleaning and odor prevention kit to overcome the mentioned shortcoming of costly fees for the need of a plumber, by using the kit to remove and prevent the occurring of clogs and odors, and also save money from purchasing fresh lemons and products that temporary remove odors from the garbage disposal, and also benefit with the kit if you only have a garbage disposal by using the mitt, and the disinfectant to keep a fresh scent inside the garbage disposal.

BRIEF SUMMARY OF THE INVENTION

The primary object of the invention kit is to provide the user a quick easy permanent odor removal from the garbage disposal, avoid the costly plumber to eradicate clogs from the drain inside of the garbage disposal that's connected to the hose of the dishwasher, and savings from purchasing lemons and other products to remove odors from the garbage disposal.

BRIEF DESCRIPTION OF DRAWINGS

The Drawings constitute a part of this specification and include exemplary embodiments to the invention, which may be embodiments in various forms. Some aspects of the invention may be shown exaggerated or enlarged to facilitate an understanding of the invention.

DETAILED DESCRIPTION OF THE INVENTION

Having often experienced the challenge for the pass twenty-six years as an on-sit property manager, calling a plumber for a clog dishwasher drain line into the garbage disposal, which causes the water to exit out of the air-vent on top of the sink, and purchasing several products to remove bad odors in the garbage disposal, FIG. 1, 2, 3, 4, 5, 6, 7, I created a convenient solution called Dishwasher/

Garbage Disposal Clog Drain Connector/Rubber Splash Guard Cleaner and Permanent Odor Prevention Kit.

Figure 1:
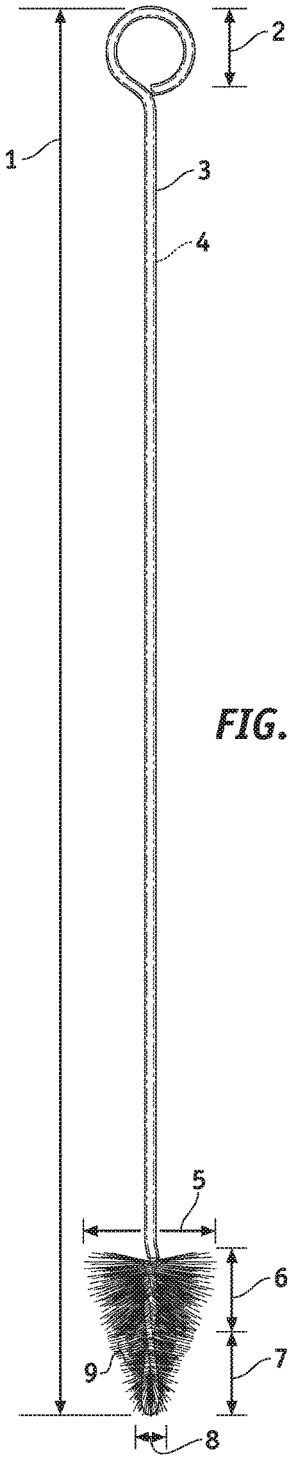
FIG. 1 View of the whole brush that's made of flexible steel metal, that's shaped with a small round circle on the top end of the handle, with a thin clear flexible material to cover the handle, and on the end a bristle conical brush head, with the measurement locations for the length, size, width of the metal and brush.
Figure 2:
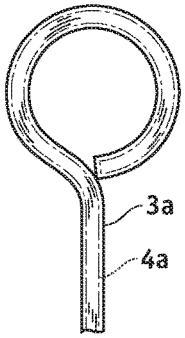
FIG. 2 View of handle with a flexible rubber coverage.
Figure 3:
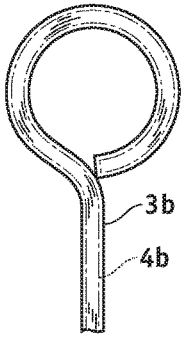
FIG. 3 View of handle with a flexible plastic coverage.

FIG. 1 Full view of a tubular steel flexible metal skeleton frame wire that measure approximately about 9" in length, and gauge of 18, #1, #2, #4, #4*a*, #4*b*, #4*c*. The top end of the handle is a circular ring of ½", to suspend from a wall when stored, and for the use of a one finger grip, #2, which contorts to accommodate the inner angles of a garbage disposal that's about 3" from the top entry of the rubber splash guard to the small inside top hole of the garbage disposal for water drainage from the dishwasher.

FIG. 1, 2,3 Metal handles is covered from the top down to the top of the brush, with a flexible clear, rubber or plastic material coating, #3, #3*a*, #3*b*, that's easily able to enter the small opening of the drain hole that's about 2" to 3" from the top of the rubber splash guard of the garbage disposal.

Figure 4:
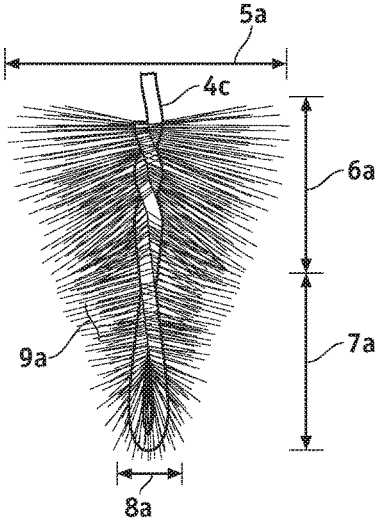
FIG. 4 View of brush showing how the bristle or attached to the metal.

FIG. 4 Full view of the brush distal end to the metal wire on the end of the skeleton that has a conical shape head, attached to the metal that's 1" in height, and ¾" wide, and bottom width is ½", #5*a*, #6*a*, #7*a*, #8*a*, which shows the connection of two small twist of the wire, that's comprised of a multitude of crisscrossing plastic bristles to attach and secure between the two-twisted oval holes of the metal wire in-between the top ½" and bottom ½" of the brush, #9*a*.

Figure 5:
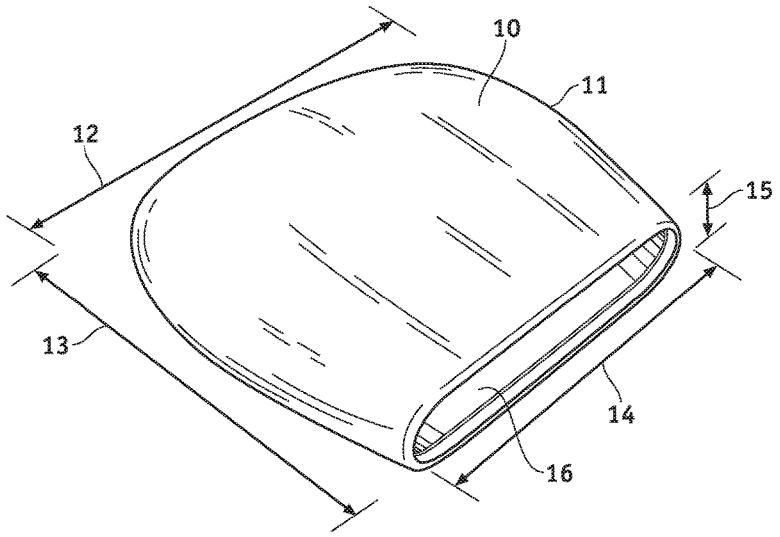
FIG. 5 View of a four-finger mitt, to cover only four fingers of the hand, water repellent lining, and show the width, length, seam, and material.

FIG. 5 Full view of the system's companion mitt is a one size fits all sleeve, designed to be used on the left or right hand, and only cover the four small fingers of the hand, and not the thumb or palm of the hand. Fabricated of a heavy-duty stretchable thread material #10, #10*a*, and the top entry of the mitt expands from 3" to 4½", to secure the fingers once inside the mitt #14, #15, and the side seam is invisible because the same material and interlocking is used #11, the height is 4½" and the bottom width of the mitt is 4½", #12, #13. The inside is laminated with a water repellent material to prevent water and waste penetration from touching the fingers, #16.

Figure 6:
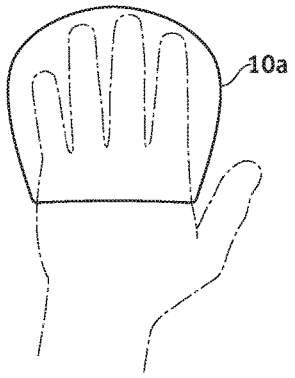
FIG. 6 View of a hand inside of the four-finger mitt, that can be used on the left or right hand to clean under the rubber splash guard of the garbage disposal.

FIG. 6 Full view sample of the four fingers inside the mitt, for left or right hand to clean under the rubber splash guard that's on the top entry of the garbage disposal, and the mitt is designed not to go pass the thumb or cover the wrist of the hand #10*a*.

Figure 7:
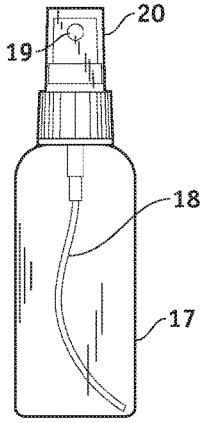
FIG. 7 View of a refillable plastic bottle with a one finger pump to spray the liquid disinfectant on the glove, mitt, and a snap on cap for the pump, size optional.

FIG. 7 Full view of another companion is a refillable plastic container bottle with a one finger spray pump, and a snap on cap to cover the pump for the liquid lemon scented disinfectant, to spray on the mitt, or brush, that's refillable with your choice of another scent or product, along with a long stem attached to the pump that goes to the bottom of the bottle, and the size is optional from 3 to 8 oz for the kit, #17, #18, #19, #20.

I claim:

1. A garbage disposal cleaning kit comprising:

a) a reusable brush having a first end, a second end opposite the first end and a middle portion, made from an 18 gauge steel metal wire skeleton frame with an overall length of 9 inches, a conical brush comprising a plurality of bristles is located on the first end of the reusable brush, said conical brush has a length of 1 inch and a maximum width of ¾ inch, the bristles are secured to the first end of the reusable brush by twisting the wire skeleton frame around bristles and upon itself for the length of the conical brush so that the bristles extend circumferentially outward from the wire skeleton frame, a circular hanging ring having a diameter of ½ inch is located on the second end of the reusable brush, the middle portion of the reusable brush is non-twisted with a length of 8 inches and is covered with a clear flexible coating of rubber or plastic; and b) a reusable mitt sized to cover only four fingers of a user's left or right hand comprising, a first end and a second end opposite the first end, the first end comprises an opening for receiving the user hand that expands from 3 inches to 4.5 inches to secure the mitt to the fingers, the second end has a width of 4.5 inches, the overall height of the mitt is 4.5 inches, the inner surface of the mitt is laminated with a water repellant material; and c) a reusable plastic spray bottle container comprising, a removable screw on and off one finger pump, a snap on cap, and the container is filled with a liquid scented disinfectant.

* * * * *